US008469218B2

(12) United States Patent
Bratsch

(10) Patent No.: US 8,469,218 B2
(45) Date of Patent: Jun. 25, 2013

(54) CLOSURE FOR A PACKAGE

(75) Inventor: Christian Bratsch, Salzburg (AT)

(73) Assignee: Xolution GmbH, Munich (DE)

( * ) Notice: Subject to any disclaimer, the term of this patent is extended or adjusted under 35 U.S.C. 154(b) by 100 days.

(21) Appl. No.: 12/736,210

(22) PCT Filed: Mar. 25, 2009

(86) PCT No.: PCT/EP2009/053521

§ 371 (c)(1),
(2), (4) Date: Sep. 20, 2010

(87) PCT Pub. No.: WO2009/118339

PCT Pub. Date: Oct. 1, 2009

(65) Prior Publication Data

US 2011/0031247 A1 Feb. 10, 2011

(30) Foreign Application Priority Data

Mar. 27, 2008 (DE) ..... 10 2008 016 221

(51) Int. Cl.
*B65D 51/20* (2006.01)
*B65D 41/32* (2006.01)
*B65D 17/44* (2006.01)

(52) U.S. Cl.
USPC ..... 220/258.5; 220/258.3; 220/278; 220/266

(58) Field of Classification Search
USPC ..... 220/258.5, 258.4, 258.3, 258.1, 256.1, 220/270, 266, 265, 260, 906, 254.3, 254.1, 220/254.9, 278, 277, 200
IPC ..... B65D 51/20,41/32, 17/44
See application file for complete search history.

(56) References Cited

U.S. PATENT DOCUMENTS

| | | | | | |
|---|---|---|---|---|---|
| 3,142,411 | A | * | 7/1964 | Fried et al. | 220/277 |
| 3,301,434 | A | * | 1/1967 | Harvey et al. | 220/231 |
| 3,833,144 | A | * | 9/1974 | Bollmann et al. | 220/267 |
| 3,949,898 | A | * | 4/1976 | Patel et al. | 220/277 |
| 4,043,479 | A | * | 8/1977 | Khoury | 220/271 |
| 4,059,201 | A | * | 11/1977 | Foster | 220/258.2 |
| 4,129,227 | A | * | 12/1978 | O'Neil et al. | 220/267 |
| 4,318,493 | A | * | 3/1982 | Jacobsen et al. | 220/270 |

(Continued)

FOREIGN PATENT DOCUMENTS

| | | |
|---|---|---|
| DE | 19643487 | 3/1998 |
| WO | 9220584 | 11/1992 |

OTHER PUBLICATIONS

English Abstract of DE19643487.

*Primary Examiner* — Mickey Yu
*Assistant Examiner* — Robert J Hicks
(74) *Attorney, Agent, or Firm* — Dykema, Gossett PLLC

(57) ABSTRACT

A closure for a package, preferably for a beverage can, the package having a lid, which has at least one off-center outlet area having an predetermined breaking line, and a cover further being provided, which is reversibly movable relative to the lid from a closed position into an open position, and a first contact surface being situated on the outlet area, which cooperates with a counter surface, which is situated on the cover, during movement of the cover, in order to press the outlet area into the package, wherein a further second contact surface, which is situated on the outlet area, is provided, which, spaced apart from the first contact surface, also cooperates with the counter surface during movement of the cover.

13 Claims, 2 Drawing Sheets

U.S. PATENT DOCUMENTS 4,465,203 A 8/1984 Lambert
4,553,684 A 11/1985 Bennett
4,585,140 A * 4/1986 Lambert et al. ..... 220/268
4,865,215 A * 9/1989 Wells ..... 220/269
5,692,633 A 12/1997 Gordon
5,695,085 A * 12/1997 Hadener ..... 220/269
2003/0000952 A1 * 1/2003 Dyren ..... 220/254.4

* cited by examiner

CLOSURE FOR A PACKAGE

BACKGROUND OF THE INVENTION

1. Field of the Invention

The invention relates to a closure for a package, preferably for a beverage can, the package having a lid, which has at least one off-center outlet area having an predetermined breaking line, and furthermore a cover being provided, which is reversibly movable relative to the lid from a closed position into an open position, and a first contact surface being situated on the outlet area, which cooperates with a counter surface situated on the cover during movement of the cover in order to press the outlet area into the package.

2. The Prior Art

Packages having an outlet area are found above all in container packages, in particular for bulk goods and liquids. In such packages, it is frequently difficult to expose an outlet area. Cans are known as an example, in which a lever must be grasped in order to press an opening into the lid of the can. Other packages have strips, using which a film is removed. In particular in the case of reclosable packages, lids which act in a formfitting or friction-locked manner are typically found.

These packages have the disadvantage that they are either complex to produce or the package can only be opened in a cumbersome or difficult manner.

A closure of the type as mentioned above is disclosed in U.S. Pat. No. 5,692,633, a second lid made of metal being situated on a beverage can, and pressing down of the pouring opening being achieved via a bead in the first lid. This embodiment has the disadvantage that both the breaking open of the intended break line of the pouring opening and also the pressing of the pouring opening into the can occur via this bead, so that relatively high forces must be used here, from which a complex, space-intensive geometry of the lid and/or the cover again results. In addition, it has been shown that such solutions do not achieve complete exposure of the pouring opening, because the occurring forces do not press the pouring opening sufficiently far into the can.

It is therefore the object of the invention to remedy the above-mentioned disadvantages of the prior art, and to provide a closure for a package, which is simple to operate and simultaneously provides extensive exposure of the outlet area.

SUMMARY OF THE INVENTION

This object is achieved by a closure of the type cited at the beginning according to the invention in that a further contact surface situated on the outlet area is provided, which, spaced apart from the first contact surface, also cooperates with the counter surface during movement of the cover. The solution according to the invention has the advantage that a first contact surface is essentially provided for breaking open the predetermined breaking line, while the second contact surface causes the pressing of the outlet area into the package.

Therefore, when the cover is moved laterally or rotationally relative to the outlet area in the lid, the counter surface presses the cover against a first contact surface, in order to press the outlet area formed on the package into the package. This allows to provide a cover which can be grasped relatively easily, in order to apply the force which is necessary to press the outlet area into the package using lever conditions which differ depending on the embodiment. The described opening mechanism is advisable in particular with a can, because the devices known from the prior art for opening a can are frequently not very user-friendly. This relates above all to round cans, for which the opening mechanism is particularly suitable, having additionally the advantage that the closure according to the invention is also capable of reclosing the can. The closure according to the invention is suitable in particular for packages which have a lid made of sheet metal. Cans having a lid made of sheet metal are used in particular for carbonated beverages, which are particularly simple to open using the described mechanism.

In a preferred embodiment of the invention, the first contact surface and the counter surface are implemented as guide bevels, while the second contact surface is preferably implemented as a guide bevel or as a protrusion. Thus, for example, a first contact surface implemented as a disconnection bevel allows the disconnection of the outlet area from the lid, and a second contact surface implemented as a pressure bevel allows the pressing or pivoting of the outlet area into the package. The action of the counter surface of the cover on the disconnection bevel in the outlet area ensures that the package is opened and the outlet area is pressed into the package in a special area upon opening of the package. In order to further open the package, the outlet area is pressed into the package via cooperation of the counter surface of the cover with a pressure bevel in such a manner that a sufficient opening for emptying the package results.

In particular for the opening of the outlet area by pressing out of the predetermined breaking line stamped into the sheet-metal, for example, higher targeted forces to be applied are necessary, which may be achieved in a simple manner via the cooperation with an inclined plane. In order to also optionally cause higher forces to act from the cover via the counter surface on the outlet area particularly easily, it is proposed that the outlet area have a surface having a bevel, which cooperates with a protruding element, such as a cam or optionally a further bevel or guide edge on the cover, in order to apply high forces to the outlet area via the cooperation of inclined planes. If the contact surface is stamped into a lid of the package, this allows the contact surface to be implemented arbitrarily in a simple manner and special bevels to be provided for the optimum force transmission.

In addition, it is provided that the outlet area is clearly bounded by an predetermined breaking line, so that upon opening, the outlet area easily detaches from the surrounding area of the package, in order to be pressed into the package. The outlet area remains connected to the remainder of the package via a web, for example, in order to be pressed into the package without detaching from the remainder of the package and falling into the package.

In a further preferred embodiment of the invention, the counter surface of the cover is receivable in a recess in the lid. For this purpose, the recess advantageously has at least one guide bevel, which is situated at an acute angle to the plane of the cover.

It is particularly preferable that the recess for receiving the counter surface of the cover is embossed in the material of the lid. In the closed position of the cover, the counter surface is initially situated in a recess in the lid of the package. During a movement of the cover relative to the lid, a pre-tension initially builds up, in that the counter surface travels out of the recess in the lid and slides along the lid plane. The counter surface subsequently reaches the first contact surface, which protrudes from the lid plane. The pre-tension is thus increased further, so that upon contact of the counter surface on the first contact surface, the outlet area is opened along the predetermined breaking line.

For example, it is proposed that at least one of the contact surfaces has a guide bevel, which is situated at an acute angle to the plane of the lid of the package. Upon cooperation of the counter surface of the cover with the guide bevel, the pressure on the outlet area can be slowly increased, preferably up to a strength which allows it to open the package. It is advantageous for this purpose if the cover is situated so it is pivotable on the outlet area. This allows contact surface and counter surface to be caused to cooperate with one another in the radial outer area, in order to use the lever resulting through the radius.

Corresponding to the shaping of the contact surfaces, the counter surface can also have a guide bevel, which is situated at an acute angle to the plane of the cover. The acute angle allows a flat ramp, which, as in a gearing, lengthens the path and reduces the required force to press the outlet area into the package.

A special embodiment variant provides that the counter surface causes a pressure on the outlet area which is oriented at an angle to the displacement direction of the counter surface. Normally, the counter surface acts on the outlet area in such a manner that the outlet area is pressed into the package in the direction of this pressure. In particular in the case of round packages, in which the cover is displaceable as a rotational movement relative to the outlet area, the outlet area is not to be pressed into the package in the direction of this rotational movement.

For many embodiment variants, it is therefore advantageous if the outlet area is pressed into the package radially to the rotational movement of the cover, for example. Outlet areas known from typical beverage cans may thus first be pressed partially into the package by the pressure of the cover, for example, in order to subsequently press the outlet area into the package in a direction angled to the rotational movement during a further movement of the cover relative to the lid. Depending on the embodiment of the package, however, it is preferable for many cases if the cover is situated so it is laterally displaceable on the outlet area.

In particular if the cover is produced from plastic, it is advantageous if the counter surface is molded in the cover. This allows the counter surface to be given a special shape in a simple manner, which optimally uses the lever forces, in order to press the outlet area into the package using minimal force.

A special variant in a very flat construction provides that the two contact surfaces are receivable in a receptacle situated in the cover. This allows the two contact surfaces to protrude from a lid plane and to be received in an area of the cover. Through a relative movement between the contact surfaces and a counter surface provided on the cover, a force acts on the outlet area to press it into the package. In order to also cause the counter surface to protrude out of the plane of the cover, without substantially increasing the height of the package, it is proposed that a lid has a recess, in which the counter surface extends relative to the lid of the package in a specific position of the cover.

The receptacle is preferably implemented as an area having reduced material cross-section of the cover for this purpose.

An advantageous embodiment provides that the cover has a seal, this preferably being situated between receptacle and counter surface. Such a seal allows a reclosing ability of the package, for example, in particular if the package is filled with liquid media.

To achieve a good seal effect, it is proposed that the seal presses against a lid under pre-tension. In order to keep the space between the cover and the remaining package free of escaping package contents even after opening of the outlet area, it is proposed that the cover have a seal extending around an opening in the cover.

Cumulatively or alternatively, it is proposed that the cover has a seal extending around a closure in the cover. The cover can thus have a closure and an opening, these areas each being enclosed by a seal. This allows easy pouring of media out of the package and secure closure of the package after the outlet area has been pressed into the package.

Production methods, such as co-extrusion or multicomponent injection molding, allow a seal to be implemented integrally with the cover. It is advantageous if the seal comprises a different material than the remaining cover, because the seal requires a high flexibility, while the remaining package requires a high stability.

An alternative embodiment provides that the seal is situated on a lid and cooperates with the cover, or seals are provided in each case on the lid and cover.

In a further preferred embodiment, it is provided that the surface of the cover facing away from the lid is implemented as essentially level around the pouring opening. Thus, for example, when drinking from a beverage can, the danger of spilling is substantially reduced. In addition, for example, contamination of the cover during storage may be removed easily and the packages are additionally better stackable.

A simple solution of the invention provides that the cover is fastened on the lid of the package. For example, in a can, the flange edge can be used for the purpose of mounting the cover so it is fixed on the lid and simultaneously rotatable.

A cost-effective production variant provides that the cover is produced from plastic. This allows the cover to be produced in arbitrary colors and cost-effectively even in large piece counts.

BRIEF DESCRIPTION OF THE DRAWINGS

The invention is explained in greater detail hereafter on the basis of nonrestrictive exemplary embodiments using associated figures. In the figures.

DETAILED DESCRIPTION OF THE PREFERRED EMBODIMENTS

Figure 1:
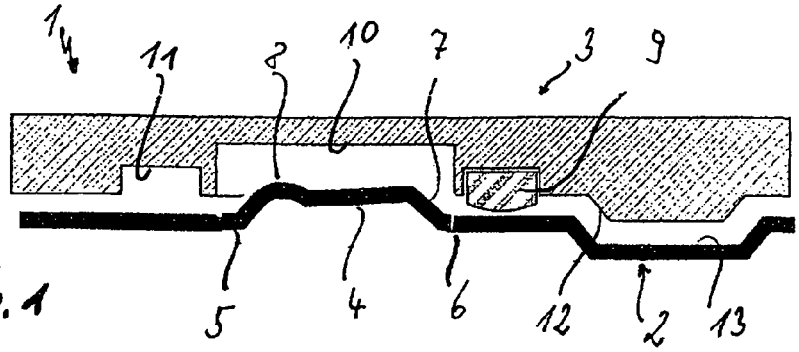
FIG. 1 schematically shows an outlet area and a cover in a first position relative to one another.

FIG. 1 shows a detail of a package having a closure 1, the package having a lid 2, over which a cover 3 is situated. The cover 3 is fastened on the lid 2 in such a manner that a relative movement is possible between cover 3 and lid 2 (not shown). In the case of a round or circular can, the cover 3, which is shown unrolled, is moved relative to the lid 2 located underneath. However, the figures clearly show that with a form of package other than a can, a lateral movement between cover 3 and lid 2 would also have the same result.

The lid 2 has an outlet area 4, which is enclosed except for a web 5 by a deeply notched predetermined breaking line 6. This outlet area 4 has a first contact surface 7, which is implemented as an inclined plane. Furthermore, a protrusion 8 is provided, which functions as a second contact surface.

In addition, the cover 3 has a peripheral seal 9, which is situated in a recess 11, in the illustrated figures, the seal 9 only being shown on the right side, while on the left side the groove 11 which receives the seal 9 is shown.

The cover 3 additionally has a counter surface 12, which is received in a first position of the cover according to FIG. 1 in a recess 13 in the lid 2, while the outlet area 4 of the lid 2 protrudes into a receptacle 10 of the cover 3.

Figure 2:
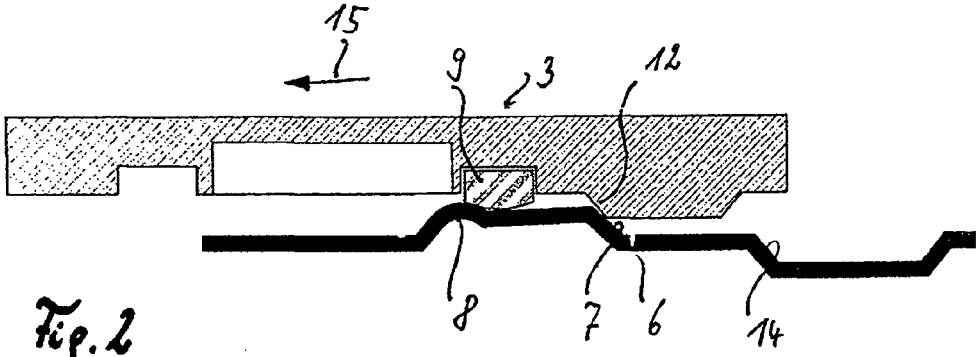
FIG. 2 schematically shows an outlet area and a cover in a second position relative to one another.
Figure 3:
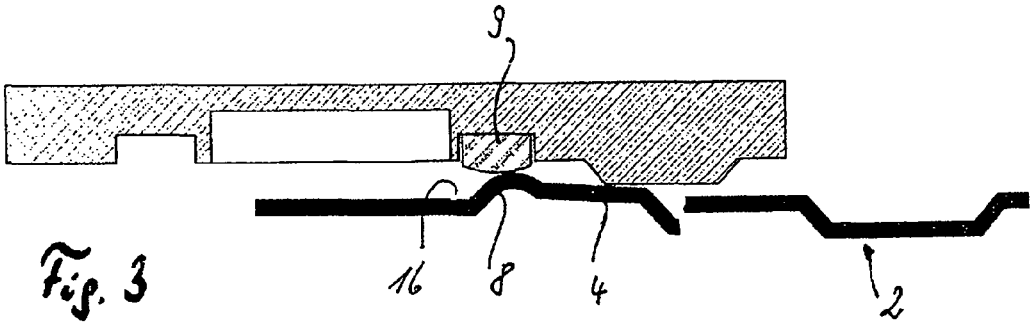
FIG. 3 schematically shows an outlet area and a cover in a third position relative to one another.
Figure 4:
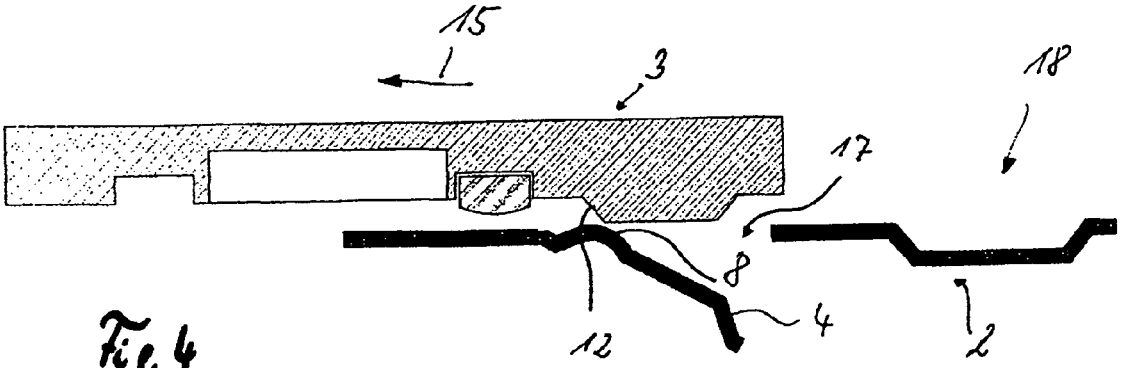
FIG. 4 schematically shows an outlet area and a cover in a fourth position relative to one another.

Upon pivoting or displacement of the cover 3 relative to the lid 2 according to FIG. 2 through FIG. 4, the counter surface 12 travels toward the first contact surface 7. The position in which the counter surface 12 presses against the first contact surface 7 is shown in FIG. 2. During this movement, the cover 3 has already lifted up somewhat from the lid 2, while the counter surface 12 has traveled on a bevel 14 out of the recess 13 in the lid 2.

During a further movement of the cover 3 in the direction of the arrow 15 relative to the lid 2, the counter surface 12 presses against the first contact surface 7, while the seal 9 presses against the protrusion 8 (FIG. 3).

In particular the pressure of the counter surface 12 against the first contact surface 7 has the result that the outlet area 4 disconnects from the lid 2 in the area of the deeply notched predetermined breaking line 6 and is pressed downward into the package. After the disconnection of the predetermined breaking line 6, the force exerted by the seal 9 on the protrusion 8 acts on the outlet area 4 in such a manner that it buckles in the area of a material weak point 16, which is provided in the web 5.

When the cover 3 is moved further in the direction of the arrow 15 relative to the lid 2, the counter surface 12 arrives at the protrusion 8, whereby the outlet area is buckled still more strongly. An opening 17 is thus created in the lid 2, which is still covered by the cover 3 in the position of the cover 3 shown in FIG. 4.

If the cover 3 is now moved further in the direction of the arrow 15, an outlet area 18, which is implemented as an opening in the cover 3, reaches the area above the opening 17 in the lid 2. Bulk material or a liquid can thus flow in a simple manner out of the package (open position of the cover 3).

During reclosing of the package, the cover 3 is moved in the direction opposite to arrow 15, until the counter surface 12 of the cover 3 is again received in the recess 13 of the lid 2, i.e., the cover 3 is again located in the closed position according to FIG. 1. The seal 9 ensures that in spite of the outlet area 4 protruding into the package, the content remaining in the package cannot exit.

It is clearly obvious to a person skilled in the art that the opening 18 in the cover 3 can also be enclosed by a seal, which lies around the opening 17 when the package is open and presses against the edge of the opening 17 on the lid 2. This prevents material escaping from the package from reaching the area between the lid 2 and cover 3.

Figure 5:
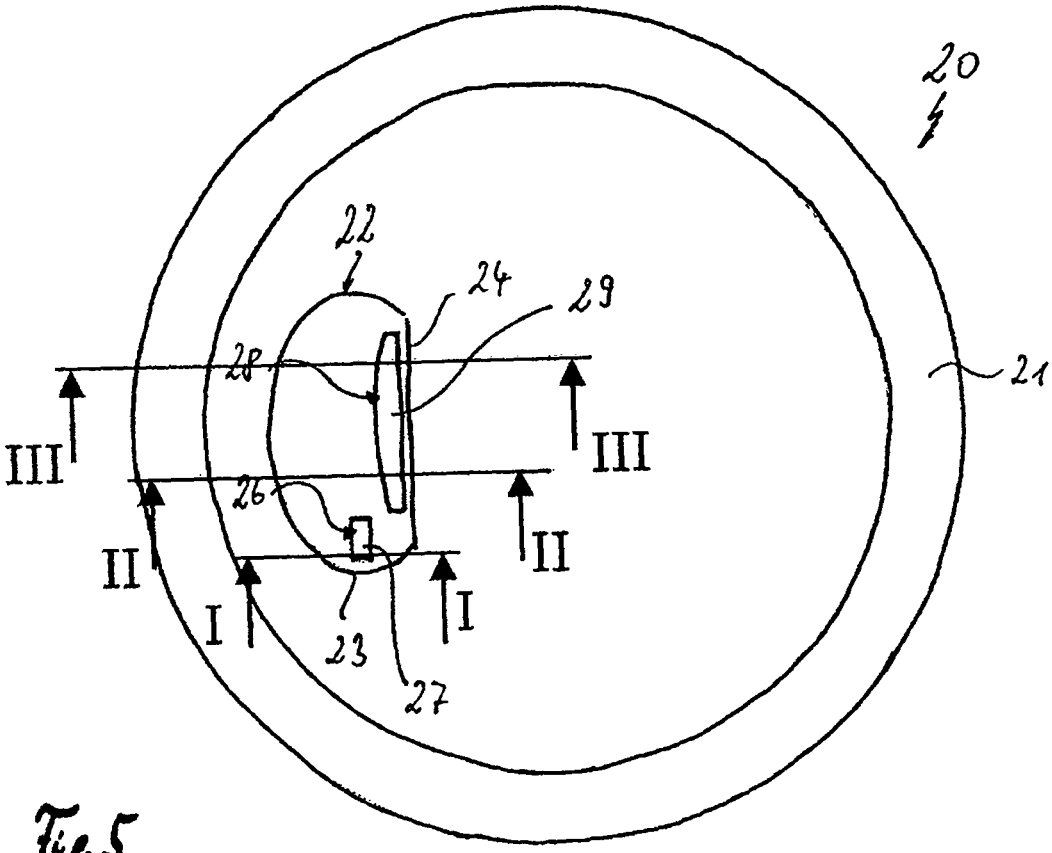
FIG. 5 shows a top view of a second embodiment of a package.

An alternative embodiment of the invention is shown in FIG. 5 through FIG. 8, a package 20 having a lid 21 without cover located thereon being shown in FIG. 5. The lid 21 has an outlet area 22, which is delimited by an predetermined breaking line 23. The outlet area 22 is only partially delimited by the predetermined breaking line 23 and is connected via a web 24 to the remaining lid 21. A material weak point 25 is provided in the area of the web 24, which makes it easier to press the outlet area 22 into the package 20.

A disconnection protrusion 26 is provided on the outlet area 22, which has a disconnection bevel 27 on its upper side. In addition, a pressure protrusion 28 is provided, which has a pressure bevel 29.

Figure 6:
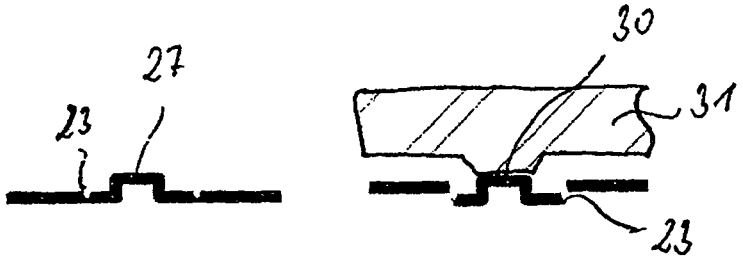
FIG. 6 schematically shows a section along line I-I in FIG. 5.
Figure 7:
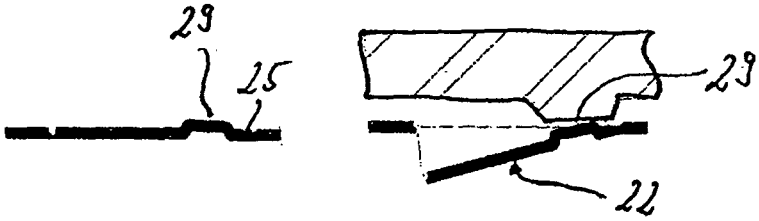
FIG. 7 schematically shows a section along line II-II in FIG. 5.

While—as shown in FIG. 6—the disconnection bevel 27 rises slightly from bottom to top, the pressure bevel 29 rises slightly from right to left according to FIG. 7, while its height (compare FIG. 7 and FIG. 8) also increases simultaneously. The slope of the disconnection bevel 27 is thus situated at a right angle to the slope of the pressure bevel 29.

Figure 8:
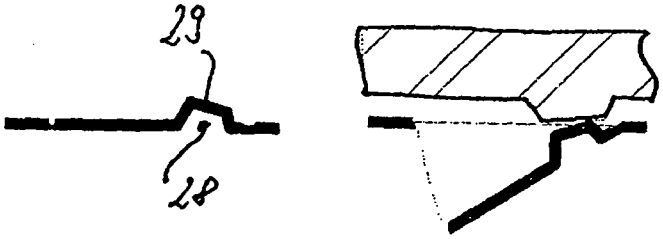
FIG. 8 schematically shows a section along line in FIG. 5.

The right side of FIG. 6 through FIG. 8 shows how the counter surface 30 of a cover 31 first acts on the disconnection surface 27 and subsequently on the pressure bevel 29. In the present exemplary embodiment, the cover 31 having a protrusion used as the counter surface 30 is pivoted away over the lid 21 for this purpose, the counter surface 30 firstly acting on the disconnection surface 27 in such a manner that the outlet area 22 tears open in the area of the predetermined breaking line 23 and bends downward easily.

The counter surface 30 subsequently engages with the pressure bevel 29, in order to press the outlet area 22 further into the package 20 through pressure on the pressure bevel 29. Because a web 24 having a material weak point 25 is provided on the right side of the outlet area 22 in FIG. 7, while an already torn predetermined breaking line is on the left side of the outlet area 22, the outlet area 22 is pressed and/or pivoted diagonally into the package.

The pressure bevel 29 in the pressure protrusion 28 is implemented in such a manner that because of its bevel, upon further rotation of the cover 31 relative to the lid 21, the counter surface 30 presses the pressure surface 29 and thus the outlet area 22 further into the package 20.

Upon further pivoting of the cover 31 relative to the outlet area 22, an opening in the cover 31 reaches a congruent location with the outlet area 22, so that liquid or bulk material can flow out of the package 20 through the outlet area 22 and the opening (not shown) in the cover 31. Secure reclosing of the package 20 is also possible here by moving the cover 31 into the starting position, sealing means (not shown) being provided in particular in the cover 22, to prevent escape of package content.

The invention claimed is:

1. A closure for a package, having a lid which has at least one off-center outlet area having a predetermined breaking line, and a cover which is reversibly movable relative to the lid from a closed position into an open position, and a first contact surface being situated on the outlet area which cooperates with a counter surface which is situated on the cover during movement of the cover in order to press the outlet area into the package, and including a second contact surface which is situated on the outlet area and spaced apart from the first contact surface, which also cooperates with the counter surface during movement of the cover, said second contact surface comprising a guide bevel or a protrusion; wherein the first and second contact surfaces of the lid are receivable in a receptacle in the cover; wherein a sealing means is situated between the receptacle and the counter surface of the cover; and wherein during movement of the cover the sealing means presses against the second contact surface while the counter surface presses against the first contact surface.

2. The closure according to claim 1, wherein the first contact surface and the counter surface are guide bevels.

3. The closure according to claim 1, wherein the first contact surface is a cam and the counter surface is a guide edge.

4. The closure according to claim 1, wherein the counter surface of the cover is receivable in a recess in the lid.

5. The closure according to claim 4, wherein the recess has at least one guide bevel which is situated at an acute angle to the plane of the cover.

6. The closure according to claim 4, wherein the recess is embossed in the material of the lid.

7. The closure according to claim 1, wherein the receptacle is an area having reduced material cross-section of the cover.

8. The closure according to claim 1, wherein the sealing means is situated on the lid and/or in the cover.

9. The closure according to claim 1, wherein the sealing means is situated around a pouring opening which is situated in the cover.

10. The closure according to claim 9, wherein the surface of the cover facing away from the lid is essentially level around the pouring opening.

11. The closure according to claim 1, wherein the cover is situated so it is pivotable to the lid.

12. The closure according to claim 1, wherein the cover is situated to be laterally displaceable to the lid.

13. A closure assembly for a package, said closure assembly comprising:

a lid which defines a recess and includes an off-center closure portion which is spaced from the recess and is connected to a remainder of the lid by a breaking line, said closure portion having a first upwardly-slanted contact surface on a side nearest the recess and a second upwardly-extending contact surface farther from the recess than said first contact surface, and a cover which is positionable over and movable relative to said lid and which defines a protrusion which can extend into said recess of said lid and which has a counter surface, a receptacle in which said first and second contact surfaces of said closure portion of said lid can extend, and a seal between said protrusion and said receptacle, said seal contacting said second contact surface when said counter surface of said protrusion contacts said first contact surface as said cover is moved relative to said lid to separate said closure portion from the remainder of the lid and provide an opening to an interior of the package.

* * * * *